US007583232B2

(12) United States Patent
Kim et al.

(10) Patent No.: US 7,583,232 B2
(45) Date of Patent: Sep. 1, 2009

(54) CHIP ANTENNA BODY AND METHOD OF MANUFACTURING THE SAME

(75) Inventors: In Young Kim, Gyunggi-Do (KR); Seok Bae, Gynggi-Do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 5 days.

(21) Appl. No.: 11/955,985

(22) Filed: Dec. 13, 2007

(65) Prior Publication Data

US 2008/0143626 A1 Jun. 19, 2008

(30) Foreign Application Priority Data

Dec. 15, 2006 (KR) ..... 10-2006-0129008

(51) Int. Cl.
*H01Q 1/38* (2006.01)
*H01Q 5/00* (2006.01)
*H01Q 9/04* (2006.01)

(52) U.S. Cl. ..... 343/787; 343/700 MS

(58) Field of Classification Search ..... 343/787, 343/700 MS

See application file for complete search history.

(56) References Cited

U.S. PATENT DOCUMENTS

2007/0161159 A1* 7/2007 Yamazaki et al. ..... 438/149

* cited by examiner

*Primary Examiner*—Anh Q Tran
(74) *Attorney, Agent, or Firm*—Lowe Hauptman Ham & Berner

(57) ABSTRACT

There is provided a chip antenna body and a method of manufacturing the same. The chip antenna body including: a plurality of minute segments formed of one of a dielectric material, a magnetic material and a mixture thereof, the minute segments arranged to be spaced apart from one another at certain intervals; and a resin filled in the intervals among the minute segments to integrally fix the minute segments.

14 Claims, 8 Drawing Sheets

CHIP ANTENNA BODY AND METHOD OF MANUFACTURING THE SAME

CROSS-REFERENCE TO RELATED APPLICATIONS

This application claims the priority of Korean Patent Application No. 2006-129008 filed on Dec. 15, 2006, in the Korean Intellectual Property Office, the disclosure of which is incorporated herein by reference.

BACKGROUND OF THE INVENTION

1. Field of the Invention

The present invention relates to a chip antenna body, and more particularly, to a structure for improving impact strength of a chip antenna body and a manufacturing method thereof.

2. Description of the Related Art

An antenna has a size proportional to a wavelength of an operating frequency. Thus a lower frequency leads to a bigger size of the antenna. Recently, mobile devices have started to provide a broadcasting service, requiring a relatively bigger sized antenna. However, the antenna for use in the mobile devices has been reduced in its size with limitations. Moreover, a smaller sized antenna is degraded in gain or bandwidth thereof. Therefore, a smaller sized antenna with broadband characteristics has been hard to achieve in the art in a relatively lower frequency band. A recent trend of smaller size and thinness of mobile electronic devices necessitates smaller and thinner components, and an internal antenna also is needed to be reduced in thickness.

In a conventional internal antenna, dielectric pellets have been employed as a dielectric antenna body. This pellet material is formed of a thin plate and thus brittle against external impact.

Studies for overcoming these disadvantages have been under way. In an ongoing research, a material like glass is added to a sintered powder and then the resultant powder is compacted and sintered. However, even in this method, in a case where a ceramic material basically having brittleness is formed of a large plate with a small thickness, the ceramic material is vulnerable to impact when a ratio between area and thickness is greater than a predetermined value. In addition, as described above, in a case where a dielectric antenna body is formed of a composite having an additive such as glass or silicone mixed therein, an antenna is changed in physical properties thereof due to the additive.

SUMMARY OF THE INVENTION

An aspect of the present invention provides a chip antenna body which maintains antenna characteristics due to permittivity thereof and withstands external impact more strongly.

According to an aspect of the present invention, there is provided a chip antenna body including: a plurality of minute segments formed of one of a dielectric material, a magnetic material and a mixture thereof, the minute segments arranged to be spaced apart from one another at certain intervals; and a resin filled in the intervals among the minute segments to integrally fix the minute segments.

The minute segments may be formed of one of a ceramic and a ferrite. The minute segments may have an identical size.

The resin may be one of a silicone resin, an epoxy resin and a polymer resin.

According to another aspect of the present invention, there is provided a chip antenna including: the chip antenna body; and a radiator formed on the chip antenna body.

According to still another aspect of the present invention, there is provided a method of manufacturing a chip antenna body, the method including: providing a board formed of one of a dielectric material, a magnetic material and a mixture thereof; dividing the board into a plurality of minute segments to have certain intervals from one another; and filling the intervals among the divided minute segments with a resin.

The providing a board may include bonding one surface of the board to a bonding plate to secure the board.

The dividing the board into a plurality of minute segments may be performed by dicing. The method may further include forming grooves at a certain depth in the board in a desired shape of segments.

The filling the intervals among the divided minute segments with a resin may include: injecting a liquid resin into the intervals among the minute segments; and drying the liquid resin.

The injecting a liquid resin into the intervals among the minute segments may include immersing the bonding plate having the minute segments bonded thereto in a container containing the liquid resin therein.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
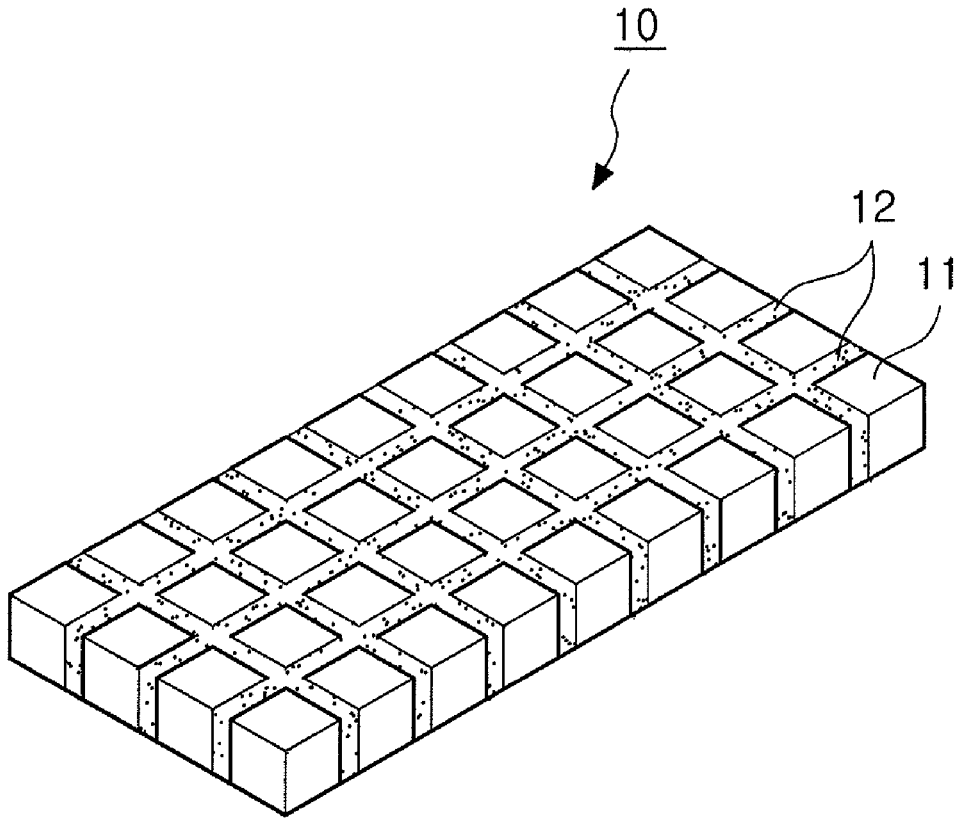
FIG. 1 is a perspective view illustrating a chip antenna body according to an exemplary embodiment of the invention.

FIG. 1 is a perspective view illustrating a chip antenna body according to an exemplary embodiment of the invention.

Referring to FIG. 1, the chip antenna body 10 of the present embodiment includes a plurality of minute segments 11 and a resin 12 filled among the segments.

The minute segments 11 may be formed by cutting a plate-shaped board formed of one of a dielectric material, a magnetic material and a mixture thereof.

The minute segments 11 may be formed of pellets produced by sintering a ceramic dielectric material having a certain permittivity or a ferrite magnetic powder.

In the present embodiment, a ferrite powder having both permeability and permittivity is employed. A magnetic dielectric board having permeability and permittivity at the same time, when employed, can shorten a resonant length of the antenna, thereby achieving reduction in size thereof.

According to the present embodiment, the minute segments 11 are formed with an identical size and rectangular-shaped. However, the minute segments are not limited thereto and may be varied in shape.

The minute segments 11 are arranged to be spaced apart from one another at certain intervals. Also, the resin 12 is filled in the intervals to integrally fix the segments.

The resin 12 may be formed of a silicone resin, an epoxy resin or a polymer resin capable of relaxing external impact.

The resin 12 is filled in the intervals among the segments to fasten the minute segments. Moreover, the resin 12, even though cured, remains slightly elastic, thereby ensuring the dielectric or magnetic board to withstand impact more strongly.

Figure 2A:
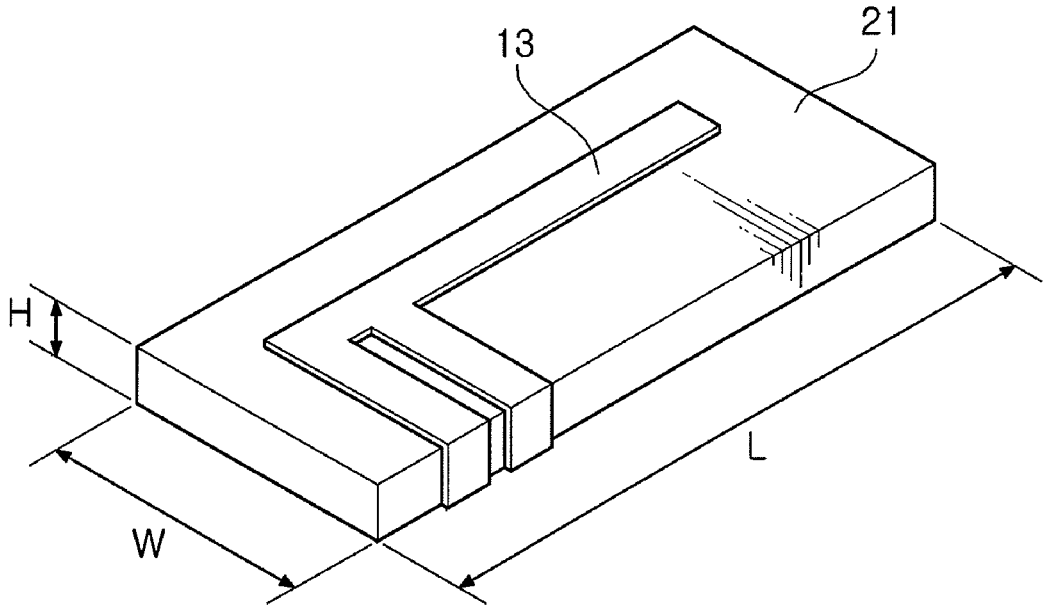
FIG. 2A is a perspective view illustrating a conventional dielectric chip antenna and FIG. 2B is a perspective view illustrating a chip antenna according to an exemplary embodiment of the invention.
Figure 2B:
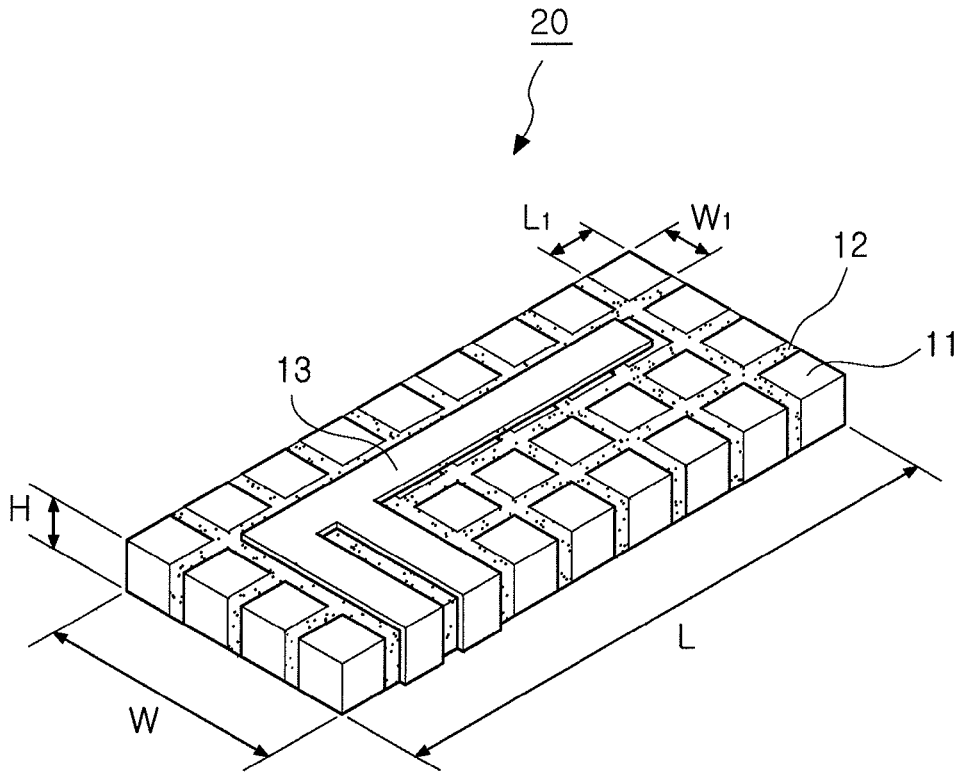

FIGS. 2A and 2B are perspective views illustrating dielectric chip antennas having identical radiators formed thereon, of which the radiator of FIG. 2A is formed on a dielectric body according to the prior art and the radiator of FIG. 2B is formed on a dielectric body according to an exemplary embodiment of the invention.

Referring to FIG. 2A, the body of the dielectric chip antenna is formed of a rectangular parallelepiped-shaped plate having a predetermined length L, width W and height H.

An inverse F-type radiator is formed on the plate-shaped dielectric body 21. The radiator 13 is formed of a copper film and attached on the dielectric body 21. The shape and manufacturing method of the radiator 13 is not limited to the present invention, but may be varied. For example, the radiator 13 may be manufactured by a printing method using a conductive paste.

In the present embodiment, the chip antenna body 21 has a length L of 40 mm, a width W of 10 mm, and a height H of 2 mm.

FIG. 2B is a perspective view illustrating a chip antenna formed on a chip antenna body of an identical size to the dielectric body shown in FIG. 2A.

Referring to FIG. 2B, a plurality of minute segments 11 each having a predetermined length $L_1$ and width $W_1$ are arranged and a resin 12 is filled among the arranged minute segments 11.

According to the present embodiment, the length $L_1$ and width $W_1$ of each of the minute segments 11 are identical to a height H of the board. That is, the minute segment 11 is 2 mm in length $L_1$, width $W_1$ and height H, respectively.

In the present embodiment, a radiator is formed in an identical shape to that of FIG. 2A.

A drop test has been conducted to examine reliability of the dielectric chip antennas shown in FIGS. 2A and 2B and the results are as follows.

To perform the drop test, the dielectric chip antennas have been installed in housing zigs weighing 150 g and then dropped from a height of 1.8 m. In the drop test, each of the antennas is dropped on the floor several times so that respective surfaces, edges and vertices thereof undergo impact. In this drop test, the dielectric chip antenna of FIG. 2A suffers damage and the dielectric chip antenna of FIG. 2B is free from damage.

As described above, the dielectric body having the minute segments fastened to one another by the resin can withstand external impact more strongly.

Figure 3A:
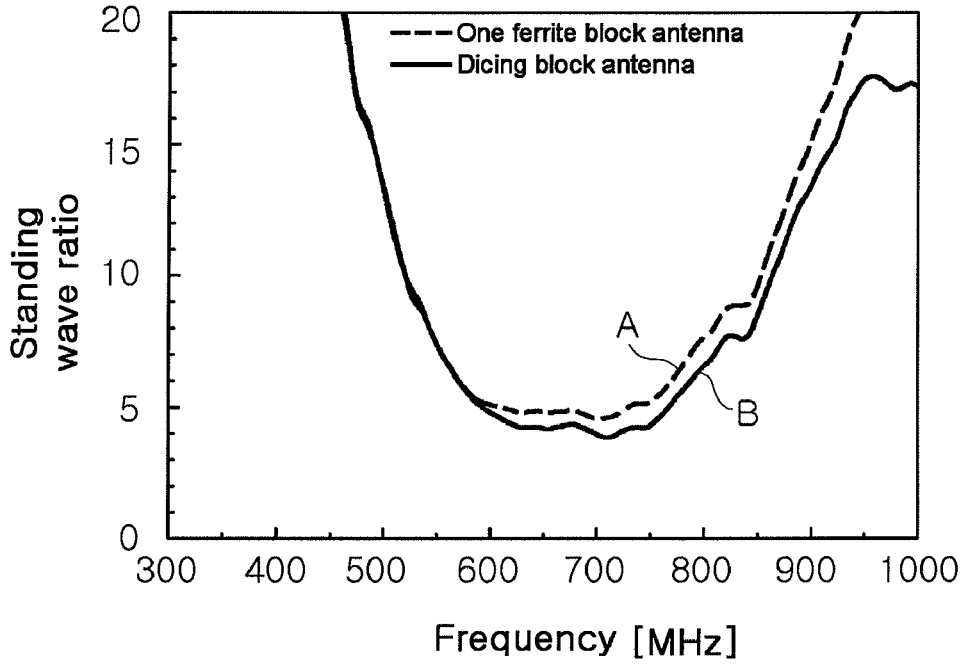
FIG. 3A is a graph illustrating standing wave ratios (SRW)s of the antennas shown in FIGS. 2A and 2B, and FIGS. 3B and 3C are graphs illustrating radiation properties of the antennas shown in FIGS. 2A and 2B, respectively.

FIG. 3A is a graph for comparing standing wave ratios (SWR)s for the dielectric chip antennas of FIGS. 2A and 2B.

Referring to FIG. 3A, the dielectric chip antenna A employing the body formed of one dielectric plate has a frequency of 560 to 770 MHz when the SWR is less than 6. The chip antenna B utilizing the body formed of the plurality of dielectric or magnetic segments exhibits a frequency of 560 to 800 MHz when the SWR is less than 6.

Figure 3B:
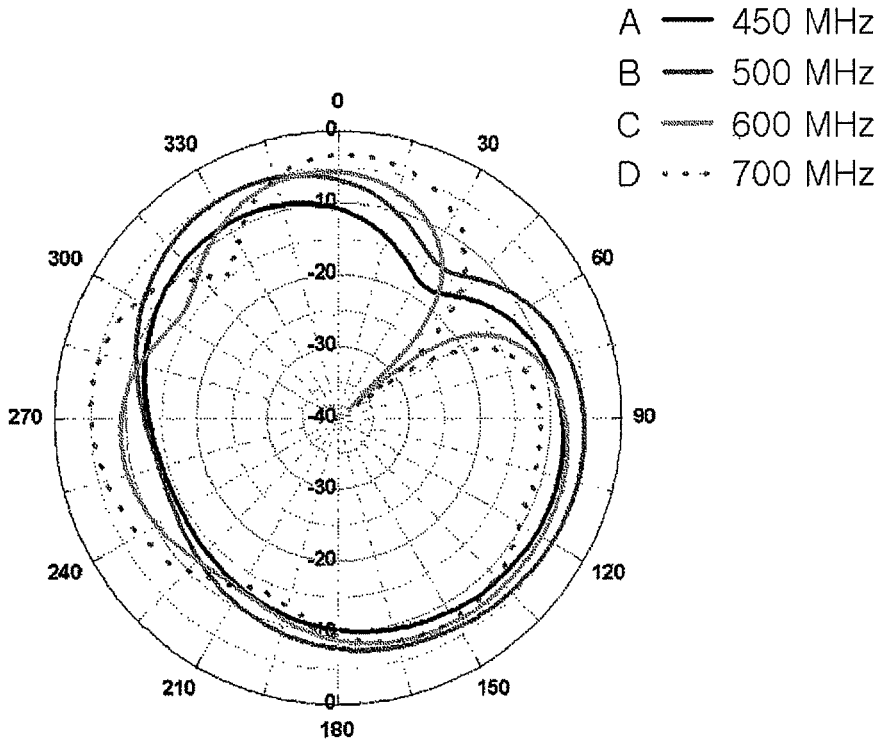

FIG. 3B illustrates a radiation pattern of the dielectric chip antenna using a body formed of the one dielectric plate shown in FIG. 2A, when the frequency ranges from 450 to 700 MHz.

Figure 3C:
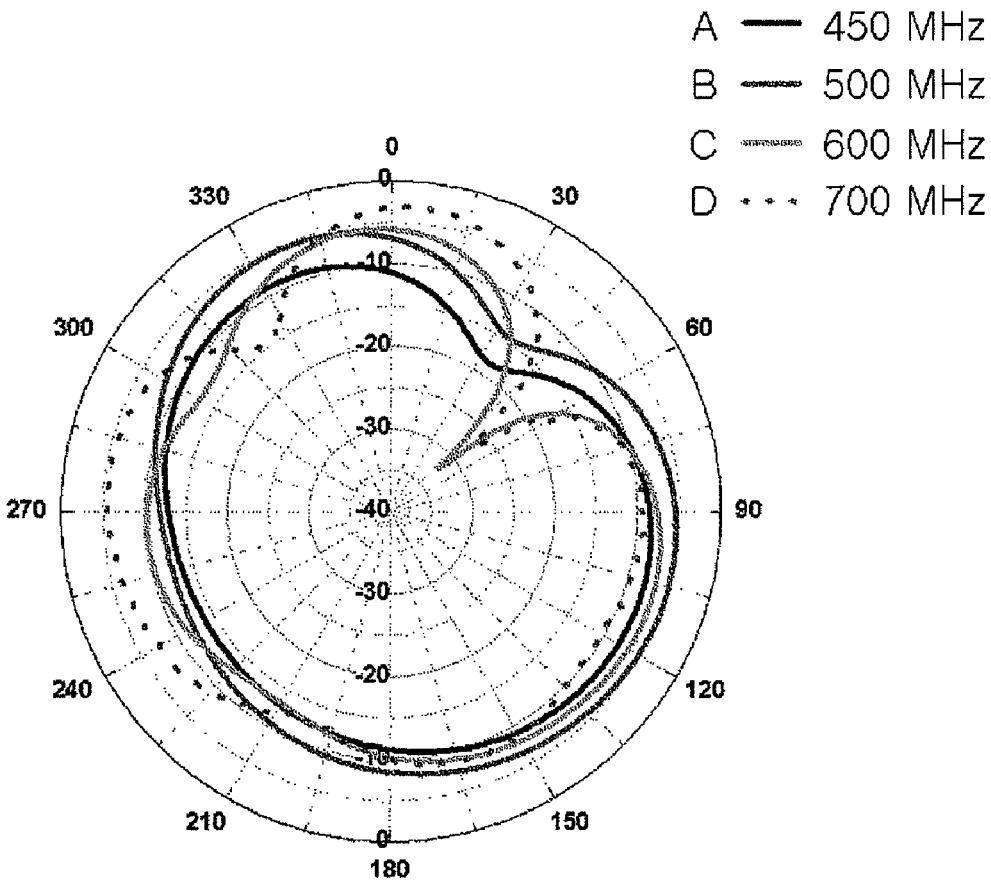

FIG. 3C illustrates a radiation pattern of the dielectric chip antenna employing the body formed of the plurality of dielectric or magnetic segments shown in FIG. 2B, when the frequency ranges from 450 to 700 MHz.

The graphs of FIGS. 3B and 3C, when compared with each other, demonstrate substantially similar radiation patterns. Therefore, the antenna of FIG. 2A is similar in characteristics to the antenna of FIG. 2B.

As described above, the antenna employing the dielectric body having the minute segments fastened to one another by the resin has characteristics similar to those of the antenna employing the body formed of the one dielectric plate.

Figure 4A:
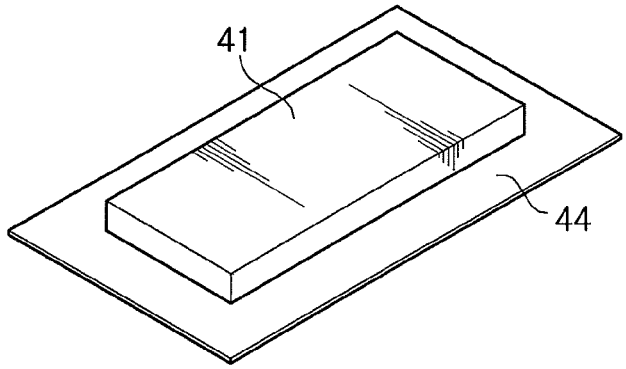
FIG. 4 is a flow chart illustrating a method of manufacturing a chip antenna body according to an exemplary embodiment of the invention.
Figure 4B:
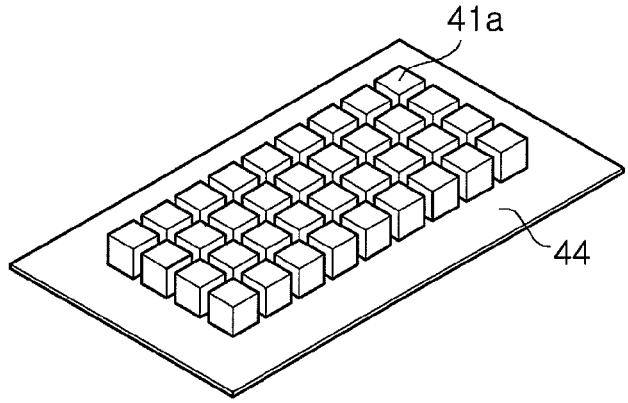
Figure 4C:
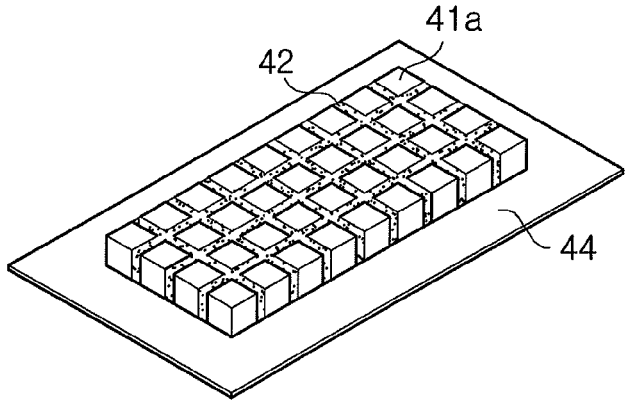

FIGS. 4 to 4C are a flow chart illustrating a method of manufacturing a dielectric body according to an exemplary embodiment of the invention.

In FIG. 4A, a dielectric or magnetic board 41 is disposed in contact with one surface of a bonding plate 44. The dielectric or magnetic board 41 may be formed of a ceramic dielectric material or a ferrite magnetic material.

The bonding plate 44 supports the dielectric body and facilitates following processes. The bonding plate 44 may be a bonding tape.

The dielectric board 41 bonded to the bonding plate 44 allows the plurality of minute segments to remain in position after being divided from one another by a dicing process later.

In FIG. 4B, the dielectric or magnetic board 41 is cut into a plurality of minute segments 41*a*.

Here, the dielectric board 41 may be cut by a dicing process using a dicing saw.

This dicing process allows only the dielectric board 41 to be cut into the minute segments 41*a*, while leaving the bonding plate intact.

The bonding plate 44 ensures the diced dielectric or magnetic segments 41*a* to remain in position.

In FIG. 4C, a resin is filled in intervals defined among the minute segments diced.

The resin 42 may be a liquid resin that is filled in the intervals among the minute segments 41*a* and then dried and cured after a predetermined time.

The resin may utilize a silicone resin, an epoxy resin and a polymer resin. According to the present embodiment, the resin is a polymer resin.

To fill the resin 42 in the intervals among the minute segments 41*a*, the liquid resin may be injected into the intervals among the minute segments. Here, an outer edge of the dielectric body formed of the dielectric segments 41*a* may be sealed to prevent the liquid resin from flowing out.

The intervals among the minute segments may be filled with the resin by various methods.

In this process, the filled resin is dried for a predetermined time so as to be cured.

Figure 4D:
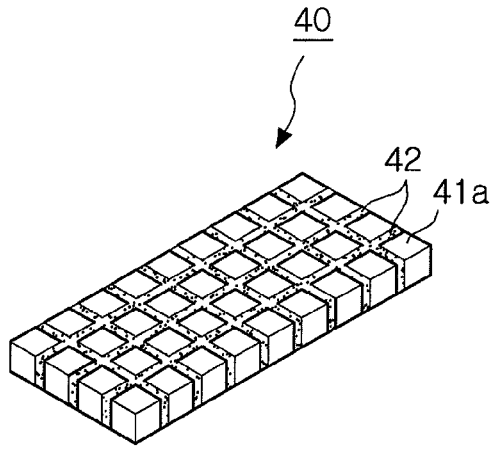

In FIG. 4D, the bonding plate 44 is removed to form the dielectric body 40.

The bonding plate 44 may prevent the diced minute segments 41*a* from being disarrayed and the liquid resin from flowing out in the process of filling the liquid resin. The bonding plate 44 may be removed when the resin 42 is completely cured to integrally fix the dielectric segments 41*a*.

FIGS. 5A to 5F are a flow chart illustrating a method of manufacturing a chip antenna body according to another exemplary embodiment of the invention.

Figure 5A:
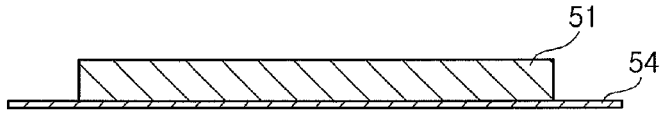
FIG. 5 is a flow chart illustrating a method of manufacturing a chip antenna body according to another exemplary embodiment of the invention.

In FIG. 5A, a dielectric or magnetic board 51 is disposed in contact with one surface of a bonding plate 54. The board 51 may be formed of a ceramic dielectric material or a ferrite magnetic material.

The bonding plate 54 supports the dielectric or magnetic board 51 and facilitates following processes. The bonding plate 54 may be a bonding tape.

The dielectric or magnetic board 51 bonded to the bonding plate 54 ensures the plurality of minute segments to remain in position after being divided from one another by a dicing process later.

Figure 5B:
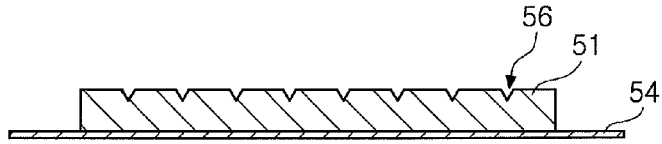

In FIG. 5B, grooves 56 are formed in the dielectric or magnetic board 51 in a desired size of dielectric segments.

The grooves 56 are formed to precisely pinpoint dicing location in a following dicing process. The grooves formed in the dielectric or magnetic board 51 facilitates the following dicing process.

Figure 5C:
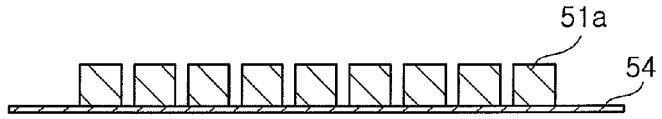

In FIG. 5C, the dielectric or magnetic board 51 is diced along the grooves 56. The dicing process may be carried out via a dicing saw. The dielectric or magnetic board 51 is divided into a plurality of minute segments 51*a* by the dicing process. The dicing saw is adjusted in height to cut the dielectric or magnetic board 51, while leaving the bonding plate 54 intact.

Figure 5D:
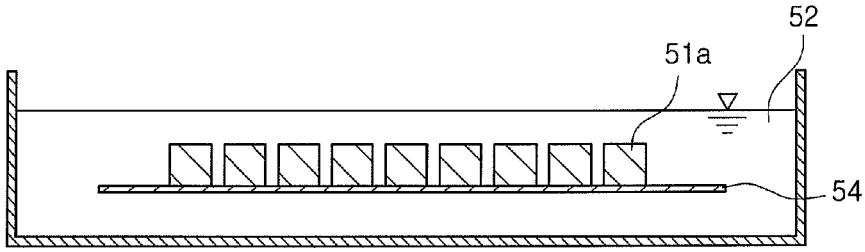

In FIG. 5D, a resin is injected into intervals defined among the minute segments divided from one another by the dicing.

In the present embodiment, the divided minute segments 51*a* and the bonding plate 54 are immersed in a container containing a resin 52 therein, thereby allowing the resin 52 to penetrate into the intervals among the segments.

When the immersed minute segments 51*a* and the bonding plate 54 are taken out of the resin, an outer edge of the dielectric segments may be walled so that the liquid resin does not flow out and is fixed in position among the minute segments.

Figure 5E:
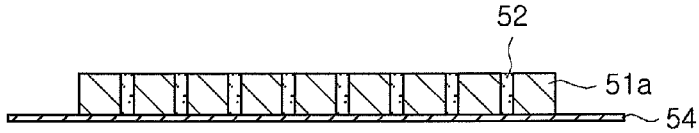

In FIG. 5E, the penetrated liquid resin is dried to be cured.

A wall (not shown) surrounding the outer edge of the dielectric segments may be formed until the resin is cured so that the liquid resin does not flow out.

Figure 5F:
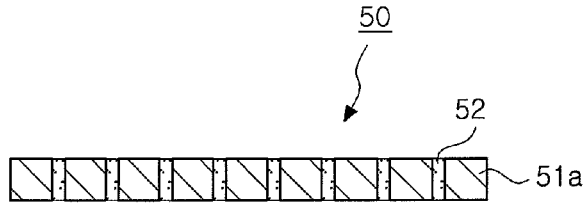

In FIG. 5F, the bonding plate is removed.

The bonding plate 54 may prevent the diced dielectric or magnetic segments from being disarrayed and the liquid resin from flowing out in the process of filling the liquid resin.

The bonding plate 54 is removed after the resin is completely cured to integrally fix the dielectric or magnetic segments.

With the bonding plate 54 removed, a chip antenna body 50 having the minute segments 51*a* integrally fastened to one another by the resin is produced.

As set forth above, according to exemplary embodiments of the invention, a dielectric body has a permittivity capable of maintaining antenna characteristics and can withstand external impact more strongly.

While the present invention has been shown and described in connection with the exemplary embodiments, it will be apparent to those skilled in the art that modifications and variations can be made without departing from the spirit and scope of the invention as defined by the appended claims.

What is claimed is:

1. A chip antenna body comprising:

a plurality of minute segments formed of one of a dielectric material, a magnetic material and a mixture thereof, the minute segments arranged to be spaced apart from one another at certain intervals; and a resin filled in the intervals among the minute segments to integrally fix the minute segments.

2. The chip antenna body of claim 1, wherein the minute segments are formed of one of a ceramic and a ferrite.

3. The chip antenna body of claim 1, wherein the minute segments have an identical size.

4. The chip antenna body of claim 1, wherein the resin comprises one of a silicone resin, an epoxy resin and a polymer resin.

5. A chip antenna comprising:

a chip antenna body comprising a plurality of minute segments formed of one of a dielectric material, a magnetic material and a mixture thereof, the minute segments arranged to be spaced apart from one another at certain intervals and a resin filled in the intervals among the minute segments to integrally fix the minute segments; and a radiator formed on the chip antenna body.

6. The chip antenna of claim 5, wherein the minute segments are formed of one of a ceramic and a ferrite.

7. The chip antenna of claim 5, wherein the minute segments have an identical size.

8. The chip antenna of claim 5, wherein the resin comprises one of a silicone resin, an epoxy resin and a polymer resin.

9. A method of manufacturing a chip antenna body, the method comprising:

providing a board formed of one of a dielectric material, a magnetic material and a mixture thereof;

dividing the board into a plurality of minute segments to have certain intervals from one another; and filling the intervals among the divided minute segments with a resin.

10. The method of claim 9, wherein the providing a board comprises bonding one surface of the board to a bonding plate to secure the board.

11. The method of claim 9, wherein the dividing the board into a plurality of minute segments is performed by dicing.

12. The method of claim 11, further comprising forming grooves at a certain depth in the board in a desired shape of segments.

13. The method of claim 9, wherein the filling the intervals among the divided minute segments with a resin comprises:

injecting a liquid resin into the intervals among the minute segments; and drying the liquid resin.

14. The method of claim 13, wherein the injecting a liquid resin into the intervals among the minute segments comprises immersing the bonding plate having the minute segments bonded thereto in a container containing the liquid resin therein.

* * * * *